United States Patent [19]

Sakurai et al.

[11] 4,210,778

[45] Jul. 1, 1980

[54] LOUDSPEAKER SYSTEM WITH HEAT PIPE

[75] Inventors: Sadaaki Sakurai, Yokohama; Hisashi Suwa, Sagamihara, both of Japan

[73] Assignee: Sony Corporation, Tokyo, Japan

[21] Appl. No.: 912,292

[22] Filed: Jun. 5, 1978

[30] Foreign Application Priority Data

Jun. 8, 1977 [JP] Japan ..... 52-74593[U]

[51] Int. Cl.[2] ..... H04R 1/02

[52] U.S. Cl. ..... 179/1 E; 179/115.5 R; 181/156

[58] Field of Search ..... 181/156; 179/1 E, 115.5 R

[56] References Cited

U.S. PATENT DOCUMENTS

| | | | |
|---|---|---|---|
| 2,217,177 | 10/1940 | Massa | 179/115.5 R |
| 3,996,604 | 12/1976 | Kimura et al. | 361/385 |
| 4,138,593 | 2/1979 | Hasselbach et al. | 179/1 E |

FOREIGN PATENT DOCUMENTS

| | | |
|---|---|---|
| 51-103934 | 8/1976 | Japan . |
| 52-12531 | 1/1977 | Japan . |
| 53-37412 | 4/1978 | Japan . |

OTHER PUBLICATIONS

IBM Technical Disclosure Bulletin, vol. 18, No. 12, pp. 3982-3983, May 1976, "Heat-Pipe Cooled Stacked Electronic Wafer Package", Kerjilian et al.

*Primary Examiner*—James W. Moffitt

*Attorney, Agent, or Firm*—Lewis H. Eslinger; Alvin Sinderbrand

[57] ABSTRACT

In an enclosed loudspeaker apparatus comprising a transducer, such as a loudspeaker, for producing acoustic radiation or sound when an electric current is applied to a drive means of the transducer, and an enclosure having an aperture in which the transducer is mounted for emission of the acoustic radiation therethrough with the drive means being in the interior of the enclosure; a heat pipe is provided for absorbing heat generated by electric current applied to the drive means, and for carrying such heat to the exterior of the enclosure so as to permit the application of increased currents to the drive means without overheating. In the case of a bass reflex, or phase-inverter loudspeaker apparatus with a reflex port extending through the enclosure, the heat pipe extends into a duct associated with the reflux port and bears a radiator with fins extending from the heat pipe to the interior surface of the duct to define a plurality of channels extending from the interior of the enclosure to the exterior thereof. The reflux port or other exit opening for the heat pipe may be positioned above the transducer so that a working fluid in the heat pipe for carrying heat from the drive means of the transducer to the exterior of the enclosure is returned toward the drive means at least in the part under the influence of gravity.

17 Claims, 6 Drawing Figures

LOUDSPEAKER SYSTEM WITH HEAT PIPE

BACKGROUND OF THE INVENTION

1. Field of the Invention

This invention relates to a loudspeaker system having a speaker enclosed in a cabinet, and more particularly to such enclosed loudspeaker systems which are provided with a heat pipe for removing heat from the voice coil of the loudspeaker.

2. Description of the Prior Art

Generally, the maximum drive current which can be tolerated by a loudspeaker is substantially determined by the ability of the voice coil to withstand elevated temperatures. Therefore, for the purposes of dissipating unwanted heat from the voice coil, it has been proposed to blacken, as with paint, the magnetic circuit elements of the speaker, especially in the portion thereof near the air gap in which the voice coil is positioned, so that heat developed in the voice coil by the drive current is radiated across the air gap and then dissipated by way of the magnetic circuit elements. However, the foregoing heat dissipation does not sufficiently remove the heat from the voice coil to permit high drive currents to be applied to the voice coil for a substantial length of time.

Accordingly, in order to radiate the heat effectively, it has been proposed that a heat pipe be provided for removing heat from the speaker drive means. In one such proposed loudspeaker, one end portion of a heat pipe is in thermal contact with the drive means for the speaker and the other end portion of the heat pipe is provided with a plurality of fins for dissipating heat generated by the drive current. Although an enclosed loudspeaker system which incorporates a heat pipe, as aforesaid, does increase the tolerable input current, such increase in the allowable current is limited as the finned portion of the heat pipe is entirely within the speaker enclosure. Thus, as long as there is no provision for removing heat to the exterior of the enclosure, the temperature at the inside of the enclosure will rise, and as a result of the elevated temperature inside the enclosure, the heat pipe can not cool the drive means efficiently.

OBJECTS AND SUMMARY OF THE INVENTION

Therefore, it is an object of the present invention to provide an enclosed loudspeaker apparatus with a heat pipe which overcomes the above-mentioned problems of the prior art.

More particularly, it is an object of the invention to provide an improved enclosed loudspeaker apparatus with a heat pipe which very substantially increases the dissipation of heat generated by the drive means of the enclosed loudspeaker apparatus.

A further object is to provide an enclosed loudspeaker apparatus, as aforesaid, which permits a substantial increase in the maximum tolerable drive current input as compared with conventional enclosed loudspeakers.

A still further object is to provide an enclosed loudspeaker apparatus of the bass reflex, or phase inverter type having a reflex port, and in which the heat radiating portion of the heat pipe is located near the reflex port so as to increase the heat dissipating capability of the heat pipe by cooperation of the heat pipe with the reflex port, and thereby ensure that heat generated by the drive means of the loudspeaker apparatus will be absorbed by the heat pipe to the maximum extent possible.

In accordance with an aspect of this invention, a loudspeaker apparatus comprises a transducer, such as a loud-speaker, having a drive means for producing acoustic radiation whenever an electric current is supplied to the drive means, an enclosure or cabinet having an aperture in which the transducer is mounted for emission of the acoustic radiation through the aperture with the drive means in the interior of the enclosure, and a heat pipe disposed to receive heat generated by the electric current in the drive means and extending to the exterior of the enclosure for carrying heat out of the latter, thereby preventing overheating of the drive means.

In one embodiment of the invention, a bass reflex port is provided in the enclosure or cabinet, and the heat pipe has a heat absorbing portion in thermal contact with the drive means of the transducer, and a heat radiating portion disposed at the reflex port for removing heat from the drive means to the exterior of the enclosure. The heat radiating portion of the heat pipe may have a radiator thereon provided with fins extending to the interior surface of a duct associated with the reflex port so as to define a plurality of individual channels between the interior and exterior of the enclosure, thereby both increasing the efficiency of heat dissipation and reducing resonance in the audible frequency range. Alternatively, the radiator may include both an inner cylinder in thermal contact with the heat radiating portion of the heat pipe and fins extending therefrom to a hollow outer cylinder integral with the fins and which acts as a duct for the reflex port.

The above, and other objects, features and advantages of the invention, will be apparent from the following detailed description of illustrative embodiments which are to be read in connection with the accompanying drawings.

DESCRIPTION OF THE PREFERRED EMBODIMENTS

Figure 1:
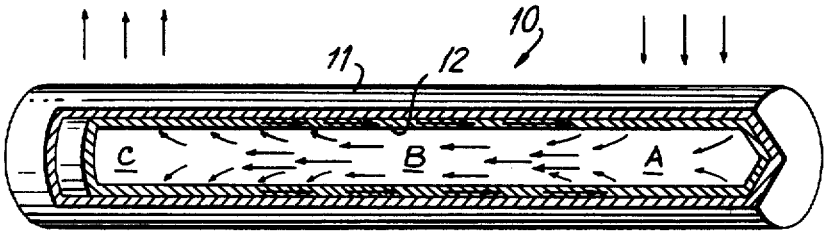
FIG. 1 PRIOR ART
FIG. 1 is a perspective view, partly broken away and in section, showing a heat pipe of a known type which can be incorporated in a loudspeaker apparatus according to this invention.

Referring to the drawings in detail, and initially to FIG. 1 thereof, a heat pipe 10 of the type whose construction and operation are well known, and which can be employed in an enclosed loudspeaker apparatus according to the present invention is there shown to include a sealed cylindrical tube 11 which has its interior wall surface lined with netted wicking material 12 impregnated with a liquid working fluid, such as water, as a heatcarrying medium. The interior of the tube 11 is at a partial vacuum so that the working fluid will evaporate at an appropriate temperature. The heat pipe 10 may be thought of as including an evaporating portion A, an adiabatic portion B, and a condensing portion C.

When a body in thermal contact with evaporating portion A, such as the magnetic circuit of a loudspeaker, achieves an elevated temperature, for example, as a result of the driving current flowing in the voice coil, heat flows into the evaporating portion A of heat pipe 10. When the liquid working fluid in evaporating portion A absorbs an amount of heat equal to the heat of vaporization of the working fluid, the working fluid evaporates. The vapor pressure in evaporation portion A increases as the working fluid evaporates and becomes higher than the vapor pressure in the condensing portion C, so that the vapor flows through the adiabatic portion B to the condensing portion C. In the condensing portion C, the heat carried by the vaporized working fluid is conducted by tube 11 to the exterior of the heat pipe 10. The vaporized working fluid is cooled and condensed and the condensing portion C of heat pipe 10 radiates the heat of liquefacation of the working fluid.

Thus, as the working fluid in the evaporating portion A absorbs sufficient heat to evaporate, and the vapor thus moves axially in the tube 11 away from portion A, unwanted heat, such as that generated in the voice coil of a loudspeaker, is transferred or carried away from the voice coil in the axial direction toward the condensing portion C of heat pipe 10 where the unwanted heat is radiated outwards therefrom.

The wicking material 12 can return the liquified or condensed working fluid from condensing portion C through adiabatic portion B to the evaporating portion A by capillary action. During operation of heat pipe 10, the amount of the working fluid in the liquid state within the evaporating portion A is less than the amount of liquid working fluid in the condensing portion C, by reason of the fact that liquid working fluid is continuously being vaporized in the evaporating portion A and the vaporized working fluid is continuously being condensed in the condensing portion C. Accordingly, the capillary pressure in condensing portion C is higher than the capillary pressure in evaporating portion A. Because of such difference in the capillary pressures, the capillary action of the wicking material 12 transports liquid working fluid from the condensing portion C to the evaporating portion A. The working liquid is continuously vaporized and condensed at nearly the same temperature, so that, in normal operation, the heat pipe 10 achieves a stable state, and the temperature gradient of the heat pipe is very small over the length of the heat pipe. In spite of the foregoing, the thermal conductivity of the heat pipe is high, that is, its thermal resistivity is low, so that a large amount of heat can be transferred.

The above described heat pipe 10 can operate in any position because of the capillary action of its wicking material 12 which functions to return the liquid working fluid from the condensing portion C to the evaporating portion A even if the latter is higher than the portion C. However, the wicking material 12 may be omitted from the heat pipe if other means are provided for returning the condensed or liquid working fluid back to the evaporating portion A. at least one such type of heat pipe without the wicking material 12 is known in which the working fluid is merely enclosed in a sealed tube which has its condensing portion C positioned above the evaporating portion A for the return, by gravity, of the condensed or liquid working fluid to the evaporating portion A. Such a heat pipe need merely be installed in a vertical or inclined position to achieve the gravitational return of the condensed working fluid.

The heat pipe described above is of relatively simple construction and is easily assembled so as to permit its economical fabrication.

Figure 2:
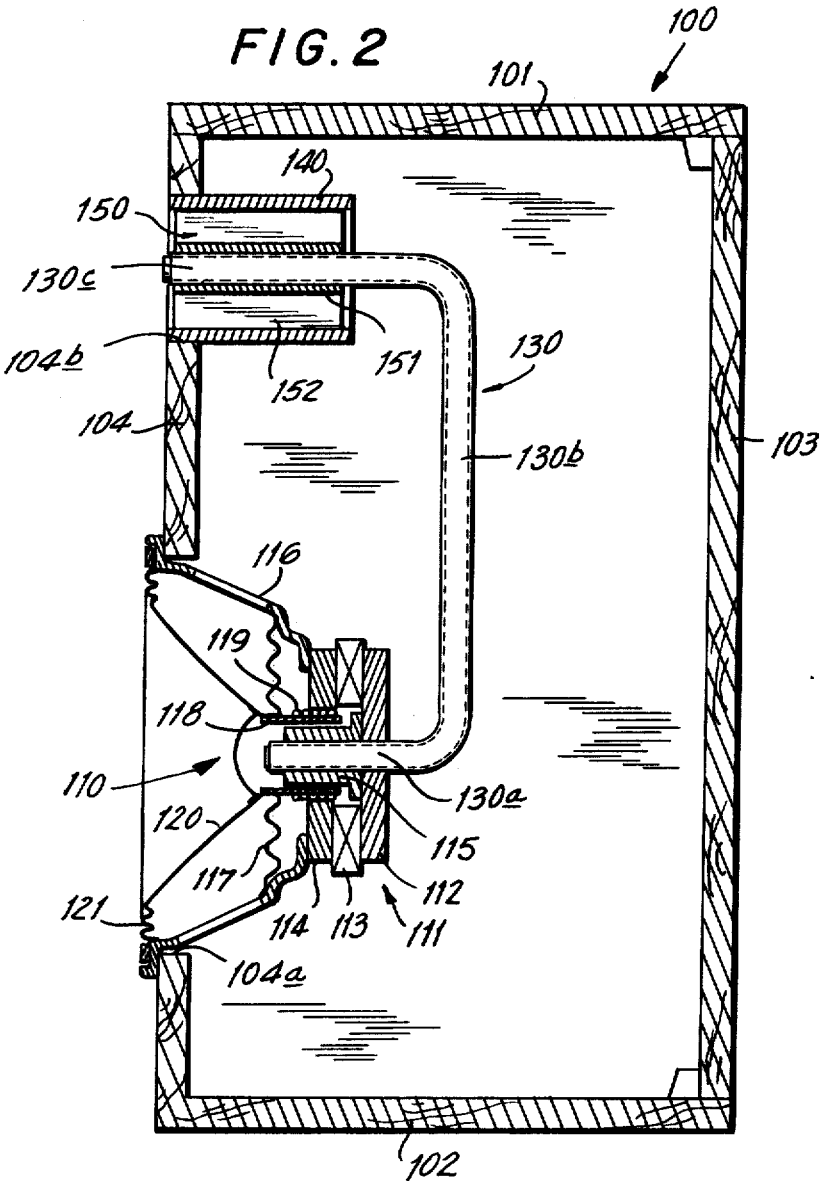
FIG. 2 is a sectional view of a bass reflex enclosed loudspeaker apparatus according to one embodiment of the present invention.

Referring now to FIG. 2, it will be seen that a first embodiment of an enclosed loudspeaker apparatus according to the present invention generally comprises an enclosure 100, a loudspeaker 110, and a heat pipe 130.

The enclosure or cabinet 100 has a top 101, a back 103, a bottom 102, a pair of sides (not shown), and a front baffle 104 with first and second apertures **104*a* 104*b* therein. The speaker 110 is attached to front baffle 104 in aperture 104*a* so that the speaker 110 can emit acoustic radiation through aperture 104*a***.

The speaker 110 contains a speaker drive 111 arranged in the interior of enclosure 100. A speaker drive includes a magnetic circuit composed of a yoke 112, a ring-shaped magnet 113, an annular top plate 114, and a cylindrical pole piece 115 extending from yoke 112 coaxially within the ring-shaped magnet 113 and the top plate 114. The speaker 110 also includes a generally conical support frame 116 whose outer, or larger-diameter edge portion is mounted on baffle 104 around the aperture **104*a*. The smaller diameter section of the support frame 116 is attached to and supports the magnetic circuit of the speaker drive 111. An annular damper 117, is fastened, at its outer edge, to the support frame 116 and, at its inner edge, to a voice coil bobbin 118. The voice coil bobbin 118 has wound thereon a voice coil 119 and is arranged within an annular gap formed between top plate 114 and pole piece 115. The voice coil bobbin 118 is connected to a substantially conical diaphragm 120 for driving the latter to produce acoustic radiation in response to application of an electric drive current to voice coil 119. The diaphragm 120 has an edge portion 121 secured to the larger diameter portion of support frame 116**.

The above described construction of speaker 110 is well known. It is also well known that the maximum input or drive current which can be applied to voice coil 119 in such speaker 110 is substantially determined by the tolerance of the voice coil 119 to heat generated by the electric drive current flowing in such coil.

In the enclosed speaker apparatus according to the present invention, the heat pipe 130 is shown to be U-shaped and to have a heat absorbing or evaporating portion **130*a* in thermal contact with the speaker drive 111, and an adiabatic portion 130*b* connecting the heat absorbing portion 130*a* to a heat radiating or condensing portion 130*c* disposed adjacent the aperture 104*b*. More particularly, the heat absorbing portion 130*a* is shown to extend axially through the center of yoke 112 and pole piece 115. The radial dimension of the annular gap formed between top plate 114 and pole piece 115 is small enough so that there is only a narrow clearance between voice coil 119 and the top plate 114 and pole piece 115. Because of the close proximity of top plate 114 and pole piece 115 to voice coil 119, heat produced in the voice coil is substantially transferred to top plate 114 and pole piece 115, and is then conducted therefrom to heat absorbing portion 130*a* of heat pipe 130**.

In the embodiment of the invention illustrated on FIG. 2, the enclosed loudspeaker apparatus is of the bass reflex or phase inverter type. Thus, the aperture **104*b* in front baffle 104 is formed as a base-reflex port and a cylindrical duct 140 extends from aperture 104b into the interior of enclosure 100. As shown, the heat radiating portion 130c of heat pipe 130 is coaxial with duct 140 along substantially the entire length of the latter and is of substantially smaller diameter than the duct 140**.

Figure 3:
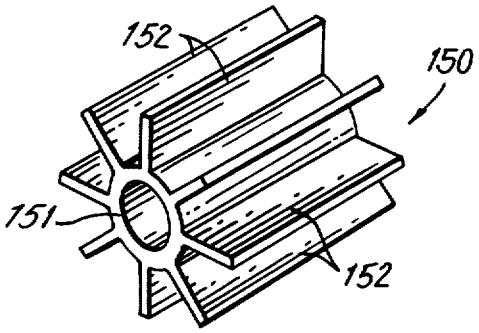
FIG. 3 is an enlarged perspective view showing a radiator included in apparatus shown in FIG. 2.

Further, in the embodiment of the invention illustrated on FIG. 2, heat radiating portion 130c is inserted into a radiator 150 which can be formed of a light alloy diecast metal. The radiator 150 may consist of an inner cylinder or sleeve 151 in intimate contact with heat radiating portion 130c, and a plurality of axially directed, angularly spaced fins 152 extending radially outward from the outer surface of cylinder 151, as shown on FIG. 3. The fins 152 are dimensioned to extend to the interior surface of cylindrical duct 140, thereby dividing the bass reflex port into a plurality of channels, each being of relatively small cross-sectional area and approximately fan-shaped in cross section.

It will be appreciated that a phase-inverted damping air current, or reflex sound wave, will be provided through duct 140 and bass-reflex port 104b during operation of speaker 110. In other words, there will be an air current flowing alternately in the inward and outward directions through duct 140 when an electric current signal is applied to voice coil 119 of the loudspeaker 110. Generally, the greater the amplitude of the electric current applied to voice coil 119, the greater will be the rate of air flow through duct 140. Since the rate of air flow through duct 140, and thus the rate of heat exchange with the radiator 150, is substantially in proportion of the amplitude of the electrical current signal applied to the voice coil 119, the cooling effect of heat pipe 130 increases substantially in proportion to increases in the electric current applied to the voice coil 119.

As previously described with reference to FIG. 1, the heat pipe 130 may use water as its working fluid, with the water being enclosed in the heat pipe at a low pressure or partial vacuum so that the water is continuously vaporized and condensed in the heat absorbing portion 130a and the heat radiating portion 130c, respectively. The operation of the heat pipe 130 will protect speaker drive 111 from an undesirable increase in temperature even when the amplitude or volume of the electric drive current or signal applied to voice coil 119 is substantially greater than that previously considered desirable. Since reflex port 104b is arranged above loudspeaker 110 in the embodiment of FIG. 2, the working fluid condensed in the heat radiating portion 130c of heat pipe 130 may be returned to the heat absorbing portion 130a thereof at least in part by the affect of gravity.

It should be noted that because radiator 150 divides duct 140 associated with the bass-reflex port into a plurality of channels, there is a substantial increase in the effective surface area for radiating unwanted heat to be carried away by the air flow through duct 140 and, therefore, the efficiency of heat radiation is significantly higher than in an arrangement without such a radiator. In addition, the fan-shaped cross section of each channel results in a decrease of unwanted resonances within duct 140 by reason of the fact that fins 152 are arranged out of parallel with each other. Further, because of the division of duct 140 into channels of small cross-sectional area, any resonance that does occur tends to be at a frequency in the ultrasonic region, that is, above the audible range of the human ear.

The duct 140 of FIG. 2 may be formed of wood fiber pulp, plastic synthetic resin, or the like. As is well known, the enclosure 100 is tuned to a resonance frequency for phase inversion by suitably selecting the length and diameter of duct 140 in accordance with the interior dimensions of enclosure 100.

Figure 4:
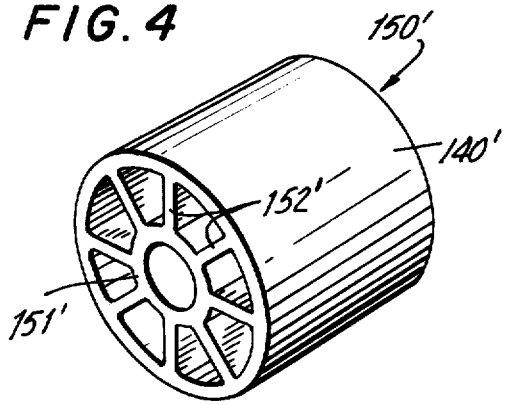
FIG. 4 is a view similar to that of FIG. 3 but showing another radiator combined with a bass reflex duct for use in the enclosed loudspeaker apparatus shown in FIG. 2.

As an alternative to the separately formed duct 140 and radiator 150, there may be used a combination duct and radiator 150' (FIG. 4) which is preferably formed of a light alloy metal and consists of an inner cylinder 151', an outer cylinder 140' coaxial therewith, and a plurality of rib-like fins 152' extending across the annular space between inner and outer cylinders 151', 140'. Such a combination radiator and duct 150' may be easily mass produced by initially extruding an elongated article having the same uniform cross-sectional shape as radiator and duct 150', and then cutting the extrusion into appropriate lengths. The combination duct and radiator 150' has its inner cylinder 151' positioned on heat radiating portion 130c of heat pipe 130, while outer cylinder 140' is snugly positioned in aperture 104b. The combined duct and radiator 150' has an effect substantially the same as the duct 140 and radiator 150 in the embodiment of FIG. 2, but its efficiency of heat radiation is even higher.

Figure 5:
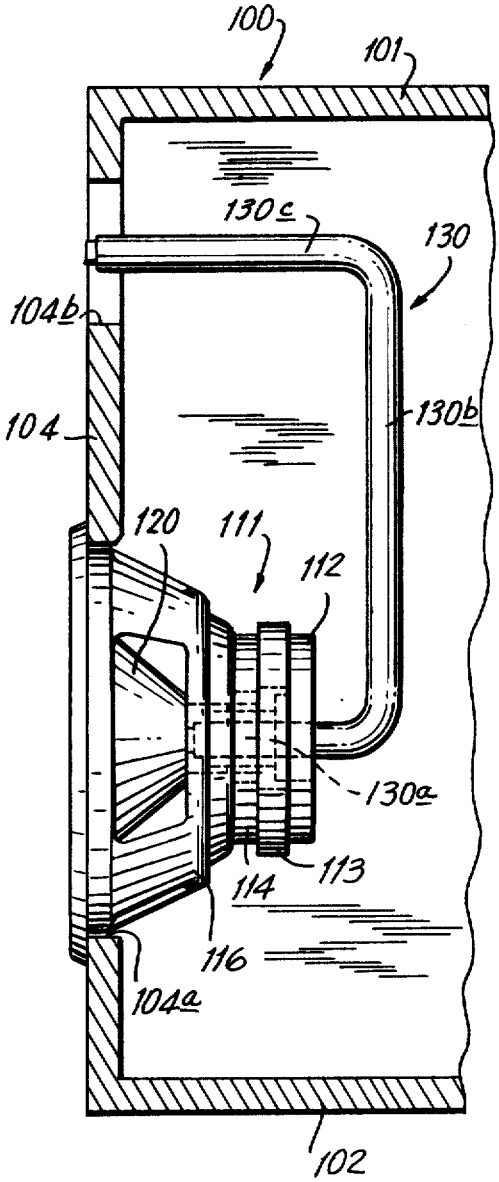
FIGS. 5 and 6 are sectional views showing other embodiments, respectively, of enclosed loudspeaker apparatus according to the present invention.

In each of the above embodiments of the invention, the radiating portion 130c of heat pipe 130 has a radiator 150, 150' thereon located within a duct 140, 140'. However, the objects of the present invention can be achieved, at least to some extent, without providing either the duct 140, 140' or the radiator 150, 150', for example, as shown on FIG. 5 in which parts corresponding to those described with reference to FIG. 2 are identified by the same reference numerals and are not described in detail. More particularly, in the embodiment of FIG. 5, the bass reflex port consists only of the aperture 104b of a diameter selected for an appropriate resonance frequency. The heat radiating portion 130c of the heat pipe 130 is located with its axis centered in the circular aperture 104b. As in the case of the embodiment of FIG. 2, any increase in the amplitude or level of the input or drive current applied to the voice coil 119 of the speaker drive 111 will result in a corresponding increase in the rate of air flow past the heat radiating portion 130c of heat pipe 130. Experiments have shown that even in the case of an enclosed loudspeaker apparatus as shown on FIG. 5, that is, without the duct 140, 140' or the radiator 150, 150', it is possible to significantly increase the tolerable input current to the voice coil 119 if, as in accordance with this invention, the heat radiating portion 130c of heat pipe 130 is lead to the exterior of enclosure 100.

Figure 6:
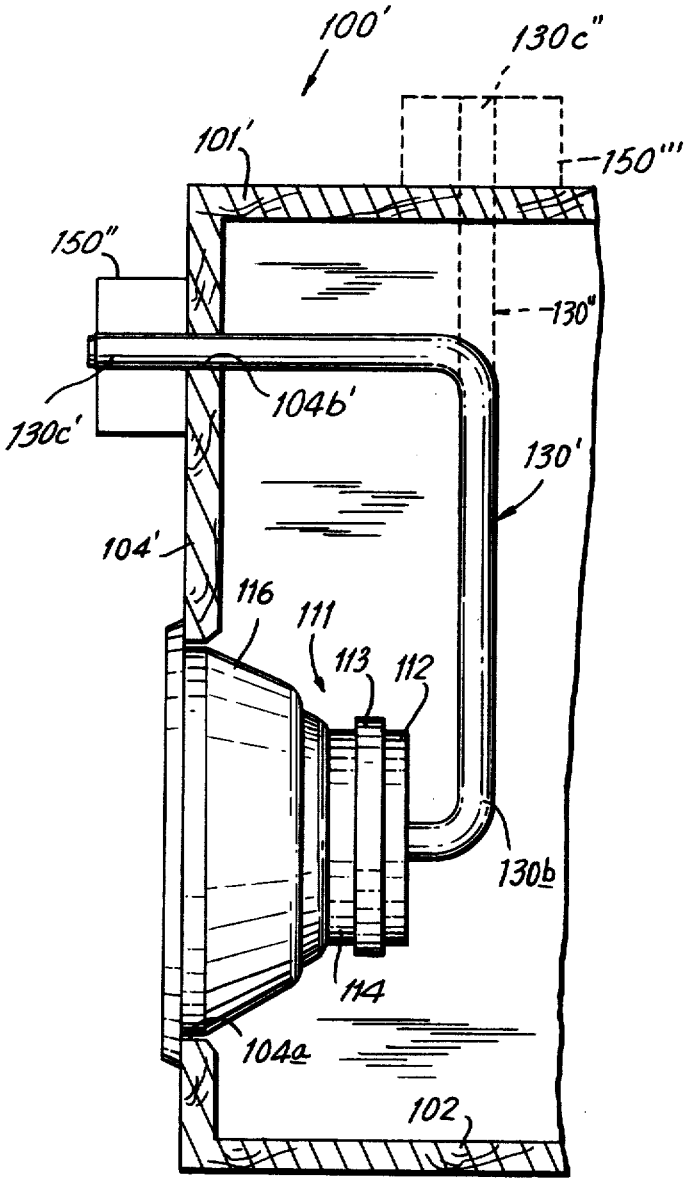

While the foregoing embodiments have been directed to loudspeaker apparatus of the bass-reflex or phase-inverter type, the present invention may also be applied to the completely enclosed loudspeaker apparatus, for example, as shown on FIG. 6, in which the parts corresponding to those described with reference to FIG. 2 are again identified by the same reference numerals and are not described in detail. In the embodiment of FIG. 6, an aperture 104b' of substantially the same diameter as the heat pipe 130' is provided in the front baffle 104' of enclosure 100'. The heat pipe 130' extends through such aperture 104b' and has its heat radiating portion 130c' located at the exterior of the enclosure 100. As shown, the externally located heat radiating portion 130c' can be fitted with a radiator 150'' in thermal contact therewith to assist in radiating heat to the atmosphere outside of enclosure or cabinet 100'

Although the heat pipe 130' is shown on FIG. 6 to extend through the front baffle 104' of enslosure 100', it will be apparent that the heat pipe may alternatively extend through any other wall of the enclosure, such as the top 101' thereof. In such case, as shown in broken lines at 130'' on FIG. 6, the heat pipe 130'' extends through an aperture in top 101' to a heat radiating portion 130c'' located at the exterior of the enclosure. Such externally located heat radiating portion 130c'' may be provided with a radiator 150''' for assisting in radiating heat therefrom to the atmosphere outside of the enclosure.

Although particular embodiments of the invention have been described in detail herein with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A loudspeaker apparatus comprising:

transducer means having a drive means and producing acoustic radiation in response to application of an electric current to drive means;

enclosure means having a first aperture in which said transducer means is mounted for emission of said acoustic radiation through said aperture with said drive means in the interior of said enclosure means, and a second aperture; and heat pipe means having a heat absorbing portion in thermal contact with said transducer means to receive heat generated by said electric current in said drive means and having a heat radiating portion extending through said second aperture to the exterior of said enclosure means for carrying such heat out of the latter, thereby preventing overheating of said drive means.

2. A loudspeaker apparatus according tc claim 1; wherein said drive means includes means defining a magnetic circuit with a gap therein, and a voice coil arranged in said gap for driving said transducer means in response to said current; and said heat absorbing portion of said heat pipe means is positioned in proximity to said magnetic gap to absorb heat generated by said circuit in said voice coil.

3. A loudspeaker apparatus according to claim 1; further comprising radiator means in thermal contact with said heat radiating portion of said heat pipe means for radiating heat from said heat radiating portion.

4. A loudspeaker apparatus according to claim 1; wherein said heat pipe means includes a sealed tube having a first end constituting said heat absorbing portion and a second end constituting said heat radiating portion, a working fluid for carrying heat from said first end to said second end, and means for returning said fluid from said second end to said first end after said heat has been radiated from the fluid at said second end.

5. A loudspeaker apparatus according to claim 4; wherein said heat radiating portion of said heat pipe means is positioned above said transducer means so that the return of said working fluid to said first end of said tube is effected at least in part, by gravity.

6. A loudspeaker apparatus comprising:

transducer means having a drive means and producing acoustic radiation in response to application of an electric current to said drive means;

enclosure means having an aperture in which said transducer means is mounted for emission of said acoustic radiation through said aperture with said drive means in the interior of said enclosure means and a reflex port extending therethrough for allowing communication between the interior and exterior of said enclosure means; and heat pipe means disposed to receive heat generated by said electric current in said drive means and extending to the exterior of said enclosure means for carrying such heat out of the latter, said heat pipe means including a heat absorbing portion in thermal contact with said drive means, and a heat radiating portion disposed at said reflex port, thereby preventing overheating of said drive means.

7. A loudspeaker apparatus according to claim 6; wherein said heat pipe means includes a sealed tube having a first end constituting said heat absorbing portion and a second end constituting said heat radiating portion, a working fluid in said tube for carrying heat from said first end to said second end, and means for returning said fluid from said second end to said first end after said heat has been carried to said second end.

8. A loudspeaker apparatus according to claim 7; wherein said reflex port is positioned above said transducer means so that the return of said working fluid to said first end of said tube is effected, at least in part, by gravity.

9. A loudspeaker apparatus according to claim 6; wherein said reflex port has a substantially greater diameter than the heat radiating portion of said heat pipe means.

10. A loudspeaker apparatus according to claim 9; further comprising a duct extending from said reflex port into the interior of said enclosure means; and wherein said heat radiating portion of said heat pipe means extends into said duct.

11. A loudspeaker apparatus according to claim 10; further comprising radiator means within said duct in thermal contact with said heat radiating portion of said heat pipe means for increasing the surface area for radiating heat from said heat radiating portion.

12. A loudspeaker apparatus according to claim 11; wherein said radiator means includes a plurality of fins extending generally radially from said radiating portion of said heat pipe means.

13. A loudspeaker apparatus according to claim 12; wherein said heat radiating portion is generally parallel with an interior surface of said duct, and said fins extend to said duct so as to abut the latter.

14. A loudspeaker apparatus according to claim 13; wherein said fins cooperate with said duct to define therebetween individual channels communicating with said reflex port and extending substantially from the interior to the exterior of said enclosure means.

15. A loudspeaker apparatus according to claim 14; in which said fins are angularly spaced so as to be non-parallel.

16. A loudspeaker apparatus according to claim 9; further comprising radiator means including a hollow cylinder axially receiving and in thermal contact with said heat radiating portion of said heat pipe means and a plurality of fins extending generally radially from and being integral with said hollow cylinder.

17. A loudspeaker apparatus according to claim 9; further comprising radiator means including an outer cylinder, an inner cylinder arranged coaxially therewith and a plurality of angularly spaced fins extending radially from said inner cylinder to said outer cylinder, said inner cylinder being in thermal contact with the heat radiating portion of said heat pipe means and said outer cylinder extending inwardly from said reflex port to extend said port into the interior of said enclosure means; said fins, said inner cylinder and said outer cylinder defining a pluarlity of individual channels establishing communication between the interior and exterior of said enclosure means.

* * * * *